United States Patent [19]

Mera et al.

[11] 4,122,376

[45] Oct. 24, 1978

[54] MULTI-INDICIA FLUORESCENT DISPLAY TUBE

[75] Inventors: Yoichi Mera; Takao Kishino; Tsutomu Morooka, all of Mobara, Japan

[73] Assignee: Futaba Denshi Kogyo K.K., Tokyo, Japan

[21] Appl. No.: 748,877

[22] Filed: Dec. 9, 1976

[30] Foreign Application Priority Data

Dec. 11, 1975 [JP] Japan ..... 50-146884

[51] Int. Cl.[2] ..... H01J 1/72; H01J 63/06; H05B 37/00

[52] U.S. Cl. ..... 315/167; 313/496; 313/519; 313/313

[58] Field of Search ..... 313/495, 496, 497, 313, 313/519; 315/167

[56] References Cited

U.S. PATENT DOCUMENTS

| | | | |
|---|---|---|---|
| 3,571,655 | 3/1971 | Tanimoto | 313/497 X |
| 3,614,546 | 10/1971 | Avins | 313/313 X |
| 3,858,073 | 12/1974 | Kohyama et al. | 313/519 X |
| 4,004,186 | 1/1977 | Bylander | 313/497 X |
| 4,045,703 | 8/1977 | Mori et al. | 313/497 |
| 4,047,072 | 9/1977 | Kishino et al. | 313/496 |

FOREIGN PATENT DOCUMENTS

| | | | |
|---|---|---|---|
| 2,107,604 | 8/1971 | Fed. Rep. of Germany | 313/519 |

*Primary Examiner*—Palmer C. Demeo

*Attorney, Agent, or Firm*—Oblon, Fisher, Spivak, McCelland & Maier

[57] ABSTRACT

A multi-indicia fluorescent display tube having a casing formed of a base plate and a cover plate bonded together, a plurality of pattern display sections provided on the base plate and each composed of a plurality of segment anodes each having a fluorescent layer thereon, a cathode stretched opposite to the pattern display sections, shield-electrode layers for preventing electrification, etc. provided on the portions of the base plate in the vicinity of the segment anodes, and a diffusion electrode for levelling the density of electron current flowing from the cathode to each of the segment anodes during operation by the influence of a positive potential applied thereto with respect to the cathode potential, said diffusion electrode being provided on the portion of the inside surface of the cover plate opposite to the pattern display sections or in the vicinity of the inside surface of the cover plate.

4 Claims, 4 Drawing Figures

MULTI-INDICIA FLUORESCENT DISPLAY TUBE

BACKGROUND OF THE INVENTION

The present invention relates to a multi-indicia fluorescent display tube. More particularly, the present invention relates to such a display tube of the diode type suitable for use in various small-sized electronic apparatus such as electronic timepieces of the digital display type, which is actuated by a driving circuit of the static drive type (hereinafter referred to as a static driving circuit) and is not provided with a control electrode or grid for controlling anode current and, in addition, can display a plurality of patterns such as characters, figures and symbols in a row by emission of uniform fluorescent light.

Generally, a fluorescent display tube uses fluorescent material able to luminesce by excitement due to bombardment of electrons thereon from the cathode, and thereby can obtain very clear luminescent display. Therefore, it is widely used for digital read-out display devices of various electronic equipment such as small-sized desk calculators and digital electronic clocks. Recently, a new fluorescent tube of the so-called multi-indicia type has come into general use, which has a plurality of pattern display sections provided side by side in a row in an air-tight vacuum casing for displaying patterns such as characters. Such a display tube generally comprises a plurality of pattern display sections provided in a row and each consisting of a group of segment anodes each having a fluorescent material layer thereon, a filament-shaped direct-heated cathode (hereinafter referred to as a filament cathode) for emitting electrons toward the pattern display sections, and control electrodes provided between each pattern display section and the cathode for accelerating and controlling electrons emitted from the cathode; and is usually actuated by a driving circuit of the dynamic drive type. However, when a fluorescent display tube is operated by such a driving circuit of the dynamic drive type, a pulse current flow, which may cause various types of noises, tends to appear in the display tube and the driving circuit. Therefore, such a display tube cannot be used for a display readout device of an electronic timepiece or the like incorporated in an electronic equipment which must be insulated from acoustical or video noises.

Therefore, in the case of such an electronic equipment which must be insulated from the above-mentioned noises, it is desirable to use a display tube which can be operated by the so-called static driving circuit without using a pulse power source. Provision of a static driving circuit makes it possible to use a multi-indicia display tube of the diode type, because direct current flows between the cathode and the segment anodes of the pattern display sections or indicia selected according to patterns such as characters to be luminescently displayed and therefore a control electrode between the cathode and each group of anodes can be eliminated. In the case of such a display tube of the diode type having no control electrode, the portions of and above the surface of the base plate around and in the vicinity of each segment anode tend to be non-uniformly and negatively charged with electrons emitted from the cathode, though a transparent conductive film electrically connected to the cathode is provided on the portion of the inside surface of the casing above the display sections so as to shield the tube from external electrical fields. If such electrification once occurs, the normal electric field and electron current between the cathode and each anode will be disturbed resulting in uneven or defective or, what is worse, insufficient luminescence of the fluorescent material layer on the segment anode.

For this reason, a fluorescent display tube used with a static driving circuit is heretofore also provided with a mesh-shaped auxiliary control electrode between the cathode and a plurality of pattern display sections. Thus, by applying a positive potential to the auxiliary control electrode with respect to the cathode potential, the display tube can obtain the normal electric field and electron current not influenced by the above-mentioned electrification between the cathode and anode.

However, the above-mentioned auxiliary control electrode must be positioned at a very close distance (usually about 0.3 mm or less) from the pattern display section composed of a group of segment anodes. In addition, it must be formed of a net of very fine meshes produced from a very thin metal sheet (about 0.05 mm thick) so as to clearly see the luminescent display of the pattern display section from above. Therefore, such a close distance of about 0.3 mm or less between the mesh-shaped auxiliary electrode and pattern display section will cause the electrification of the portions around and in the vicinity of each segment anode on the base plate to have an influence which results in insufficient luminescent display. Moreover, in the case of a fluorescent display tube having pattern display sections adapted to show larger-sized patterns, the auxiliary control electrode, which is formed of a mesh-shaped thin metal sheet, must be made large in size and therefore becomes liable to deformation such as expansion or contraction due to the change of ambient temperature or the like during or after the production process of the tube with the result that the control electrode and adjacent segment anode cannot be held at a proper distance or, what is worse, comes into contact with each other. For this reason, it has been very difficult to make the fluorescent display tube with an auxiliary control electrode of the above-mentioned construction suitable for use in a digital timepiece or the like adapted to show larger-sized patterns.

Besides, there have been also proposed various kinds of fluorescent display tubes of the static drive type in which a control electrode is provided around and in the vicinity of each pattern display section composed of a group of segment anodes and, at the same time, substantially flush with the segment anodes, without providing the above-mentioned mesh-shaped auxiliary control electrode. The use of such a control electrode known as a flat-type control electrode makes it possible to produce the tube very easily and inexpensively, to eliminate the possibility of the control electrode being deformed as in the case of the mesh-shaped control electrode, and to eliminate the need for the above mesh-shaped shield.

However, in the above-mentioned case, there is provided an insulating layer between the segment anodes on the base plate and the flat control electrode surrounding the segment anodes. Therefore, the surface of the insulating layer tends to be electrified during operation and thereby the electrical field between the cathode and anode is disturbed resulting in uneven luminescence of the pattern display sections.

The above-mentioned fluorescent display tube having flat-type control electrodes has a potential distribution between the cathode and anode during operation as shown in FIG. 1. Electron currents 4 flow from filaments of the cathode 1 to segment anodes 3 on the base plate 2 as shown, under the influence of an electric field produced by potentials applied to the cathode 1, a transparent conductive layer provided on the inside surface of the window portion of the cover plate and electrically connected to the cathode so as to shield the tube from external electric fields, the segment anodes 3, and flat control electrodes 5 provided in the vicinity of the respective groups of the segment anodes 3 and on a plane substantially flush therewith. Since the control electrode 5 is substantially on the same plane as the segment anode 3, the electric field produced is not smooth and therefore its electronic optical effect makes it impossible to obtain a uniform density of the electron current 4 flowing from the cathode and the segment anode with the result that the fluorescent material layer 6 on the segment anode 3 luminesces unevenly. Especially, in the case of a digital electronic clock or the like which displays patterns larger in size, the above-mentioned uneven luminescence poses serious problems. In the foregoing case, the density of the electron current can be levelled to some extent by increasing the number of cathode filaments, but the increase in the number of cathode filaments will result in an increase in power consumption.

BRIEF SUMMARY OF THE INVENTION

It is an object of the present invention to provide a multi-indicia fluorescent display tube which can eliminate the above-mentioned disadvantages of the prior art.

It is another object of the present invention to provide a multi-indicia fluorescent display tube which is of the diode type and suitable for use with the so-called static driving circuit.

It is still another object of the present invention to provide a multi-indicia fluorescent display tube which can display larger-sized patterns such as characters, figures and symbols.

According to the present invention, there is provided a multi-indicia fluorescent display tube for use with a static driving circuit, having a casing formed of a base plate and a cover plate airtightly bonded together, said casing containing therein at least a plurality of pattern display sections provided on the base plate in a row for displaying patterns such as characters and each composed of a plurality of segment anodes each having a fluorescent material layer thereon and a cathode stretched opposite to the pattern display sections; which comprises shield-electrode layers provided on the portions of the base plate near the segment anodes for preventing electrification and intercepting external electric fields, and a diffusion electrode for levelling the density of electron current flowing from the cathode to each segment anode during operation by a positive potential applied thereto with respect to the potential of the cathode, said diffusion electrode being provided on the portion of the inside surface of the cover plate opposite to the segment anodes or on a plane positioned near the inside surface of the cover plate.

DETAILED DESCRIPTION

Figure 2:
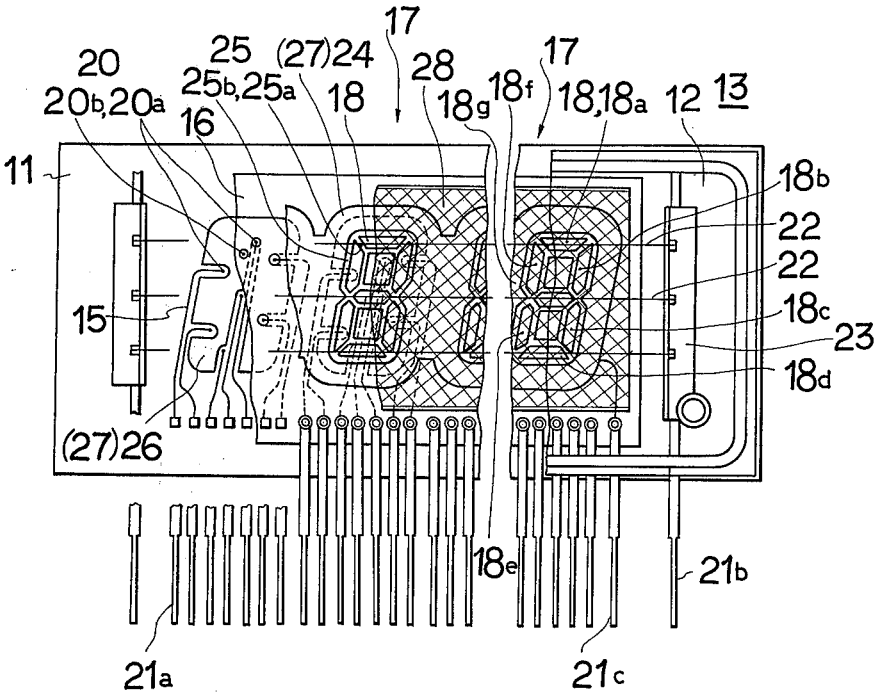
FIG. 2 is a partially cutaway plan view of an example of the fluorescent display tube according to the present invention, showing its essential part.
Figure 3:
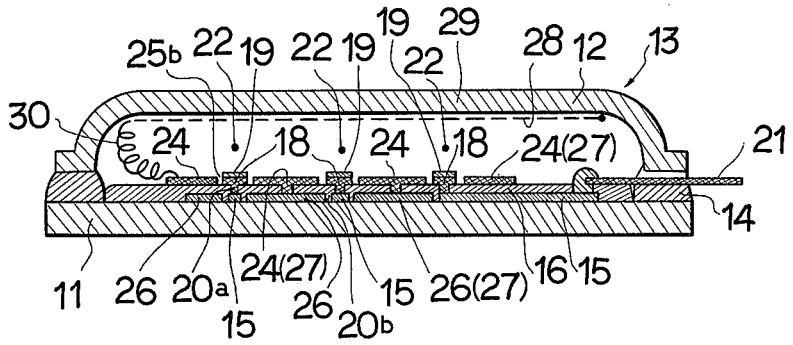
FIG. 3 is a sectional side view of the display tube of FIG. 2, showing its essential parts.
Figure 4:
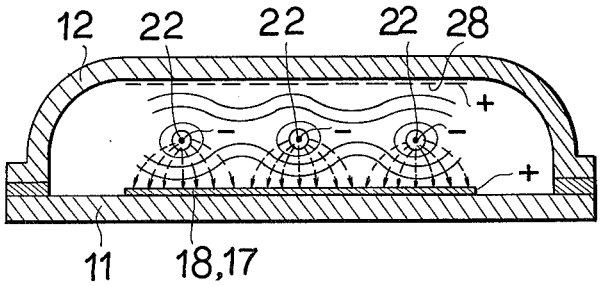
FIG. 4 is a schematical sectional side view of a fluorescent display tube according to the present invention, showing its potential distribution.

Now the present invention will be hereinafter described in detail with reference to FIGS. 2 to 4.

Reference numeral 11 designates a base plate made of an insulating material such as glass or ceramics, and the numeral 12 designates a cover plate formed of a transparent glass plate or the like. A vacuum casing 13 is formed of the base plate 11 and the cover plate 12 airtightly bonded together at the peripheral edges thereof. The seam of the casing 13 is designated by the numeral 14. A plurality of wiring layers 15 and an insulating layer 16 are coated in a laminated manner on the upper surface of the base plate in the casing 13. A plurality of pattern display sections 17 coated side by side in a row on the upper surface of the insulating layer 16. Each of the pattern display sections is composed of a plurality of segment anodes 18 (18*a*, 18*b*, —, 18*g*) so as to selectively display a plurality of patterns such as characters, figures and symbols. In the example shown, each of the pattern display sections are formed of seven segment anodes 18*a*, 18*b*, — and 18*g* arranged in the form of the block digit 8 so as to selectively display any digit between 0 and 9. A fluorescent material layer 19, which luminesces when excited by bombardment of electrons, is coated on the upper surface of each of the segment anodes 18. The segment anodes 18 are electrically connected to terminal lead-in wires 21*a* for segment anode, respectively, through a plurality of connecting holes 20 (20*a*) provided in the wiring layers 15 and the insulating layer 16.

Reference numeral 22 designates a cathode composed of filaments made of a high melting-point metal such as tungsten and coated with a coating material high in thermion-emission efficiency. The cathode 22 may be composed of one or a plurality of filaments stretched parallel to each other and opposite to the pattern display sections and supported by filament supports 23 provided at both ends of the casing. The cathode 22 is connected to terminal lead-in wires 21*b* for cathode through the filament supports 23.

A plurality of electrification-preventing layers 24 are provided on the upper surface of the insulating layer 16 near and around the segment anodes 18 (18*a*, 18*b*, —. and 18*g*) and flush therewith, in order to prevent electrification due to electrons emitted from the cathode 22. In addition, a shield layer 26 is provided on the upper surface of the base plate 11 opposite to the pattern display sections 17 with the insulating layer 16 therebetween, in order to prevent electrical fields penetrating through gaps 25 (25*a*) between the segment anodes and gaps 25*b* between each segment anode 18 and electrification-preventing layer 24. The electrification-preventing layers 24 and the shield layer 26 are collectively designated as shield-electrode layers 27. The electtrification-preventing layers 24 and the shield layer 26 are electrically connected to each other through connecting holes 20 (20*b*) provided in the insulating layer 16, and to terminal lead-in wires 21*c* for shield-electrode through the wiring layers 15.

Reference numeral 28 designates a mesh-shaped diffusion electrode provided in the vicinity of the inside surface 29 of the cover plate 12 opposite to the pattern display sections 17 and cathode 22. The diffusion electrode 28 is a net of coarse meshes formed of very fine wires knitted into a grid, honeycomb or other suitable shapes, and is held in position by bonding it to a plurality of suitable portions on the inside surface 29 using an adhesive such as crystalline frit glass low in melting point. In addition, the diffusion electrode 28 is electrically connected to the electrification-preventing layer 24 on the base plate 11 through a strip-shaped connector 30 connected to a suitable portion of the electrode 28. The diffusion electrode 28 thus arranged is operated by a positive potential applied thereto and to the shield-electrode layer 26 with respect to the potential of the cathode 22, and diffuses the electron current flowing from the cathode 22 to each segment anode 18 thereby to form an electric field which can level the density of electrons.

As mentioned above, the casing 13 kept at vacuum and composed of the base plate 11 and the cover plate 12 bonded to each other at the seam 14 contains therein the wiring layers 15, shield layer 26 forming a part of the shield-electrode layers 27, insulating layer 16, a plurality of pattern display sections 17 each composed of a plurality of segment anodes 18 each having a fluorescent material layer 19 thereon and the electrification-preventing layers 24 forming the other part of the shield-electrode layers 27, the above-mentioned elements being provided on the base plate in a laminated manner; and, in addition, contains therein the cathode 22 stretched opposite to the pattern display sections 17, the diffusion electrode 28 provided near the inside surface 29 of the cover plate 12, and the like.

Each segment anode 18, cathode 22, shield-electrode layers 27 (24 and 26) and diffusion electrode 28 are electrically connected to the external power source through the respective terminal lead-in wires 21*a*, 21*b* and 21*c* penetrated through the seam 14, as mentioned above.

Figure 1:
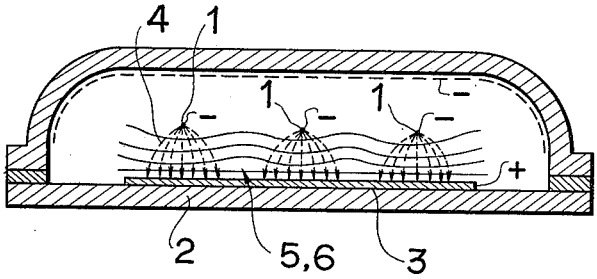
FIG. 1 PRIOR ART
FIG. 1 is a schematical sectional side view of a conventional fluorescent display tube of the diode type, showing its potential distribution.

The fluorescent display tube according to the above-mentioned embodiment of the present invention is suitable for use with an static driving circuit and is operated as follows:

The electrification-preventing layers 24 and the shield layer 26 are provided with a positive bias potential with respect to the cathode potential, preferably with a bias potential between the anode potential and the average of the cathode and anode potentials. In addition, direct current is made to flow between the cathode 22 and the segment anodes 18 (18*a*, 18*b*, —, and 18*g*) selected according to patterns to be displayed, under the so-called static driving system. Thus, any given patterns can be luminescently displayed on the desired pattern display sections or indicia. In this case, the potential distribution between the cathode and anode in the display tube is shown in FIG. 4. In this respect, more detailed descriptions will be given below:

As shown in FIG. 1, a conventional fluorescent display tube has disadvantages in that the density of electrons colliding with portions around the segment anodes near the cathode becomes large resulting in uneven luminescence. However, according to the present invention, the display tube is operated by giving a positive potential to the diffusion electrode 28 and shield-electrode layers 27 (24 and 26) with respect to the cathode potential. Therefore, the electric field thus produced diffuses and levels the density of electric current flowing from the cathode 22 to each segment anode 18 thereby to make electrons collide with each segment anode substantially uniformly. For this reason, the display tube according to the present invention of the diode type can produce, without using any control electrode between the cathode and anode, a uniform luminescent display with no uneven brightness. In addition, as shown in FIG. 4, the potential gradient in the vicinity of the cathode 22 is greater than that in the case of the conventional tube shown in FIG. 1 and therefore the amount of electrons colliding with the segment anode 18 becomes greater with the result that the display tube of the present invention can produce a luminescent display clearer and brighter than the conventional one. The results of various comparative experiments conducted by the inventor and others show that, when the same voltage is applied between the cathode and anode, the display tube according to the present invention shown in FIG. 4 produces a luminescent display brighter than the conventional one shown in FIG. 1 by about 50%.

Furthermore, according to the present invention, the display tube is provided with the shield-electrode layers 27 positioned on the upper surface of the base plate 11 near each segment anode 18 and thereby prevents electrification of portions in the vicinity of gaps between the segment anodes 18 due to electrons emitted from the cathode 22 and, in addition, prevents electric fields caused by various near-by electrical equipment from penetrating into the electron-flowing portion between the cathode and anode from under the base plate 11. Therefore, the display tube according to the present invention can eliminate defective display or the like caused by electrification and external electric fields, which occurs in the case of a conventional display tube of the diode type with no control electrode and, in addition, it can produce very clear luminescent display, since it has no control electrode immediately above the pattern display sections, which would decrease clearness of the luminescent display.

As mentioned above, the diffusion electrode 28 is disposed in the vicinity of the inside surface 29 of the cover plate 12 and produce an electric field for diffusing electron current flowing from the cathode 22 to segment anodes 18. Therefore, it does not require so severe mounting and dimensional accuracies as the conventional control electrode (grid) provided between the cathode and anode, and as a result it can be efficiently mounted on the cover plate or the like with ease. Moreover, when the diffusion electrode 28 is of net-shaped, the meshes of the net may be made coarser than in the case of the control electrode and may be formed of very fine wires knitted into a grid or honeycomb. More particularly, the opening area ratio of the net-shaped control electrode usually used is about 80%, while that of the net-shaped diffusion electrode of the present invention is as large as about 90 to 95%. Consequently, the diffusion electrode according to the present invention is easy to produce and can give a clear view of the pattern display sections from above.

In the above-mentioned embodiment, the diffusion electrode is shown as formed of a net provided in the vicinity of the inside surface 19 of the cover plate. However, it is not limited to this embodiment. Of course, it may be formed of a net-shaped conductive layer with fine meshes or stripes provided on the portion of the inside surface of the cover plate 12 opposite to the pattern display sections by printing, etc., or may be formed of a transparent conductive layer provided thereon such as a tin-oxide layer known as nesa, or may be formed of both the above-mentioned net-shaped conductive layer and transparent conductive layer coated on the inside surface of the cover plate 12. If the diffusion electrode is formed of a transparent conductive layer or the like coated on the inside surface of the cover plate 12 as mentioned above, very clear display can be observed since there is no net-shaped electrode which would more or less reduce visibility of the luminescent display of the pattern display section 17. When the diffusion electrode is formed of only the transparent conductive layer, it is desirable that the conductivity of the layer should be about 100Ω/cm or less, preferably several to several tensΩ/cm.

Furthermore, the diffusion electrode may be made up of a transparent conductive layer coated on the portion of the inside surface of the cover plate 12 opposite to the pattern display sections and a net-shaped member provided in the vicinity of the transparent conductive layer, as a matter of course. With such an arrangement, the transparent conductive layer may be formed of a layer low in conductivity such as a nesa layer having a conductivity of about several hundreds to scores of thousands Ω/cm; and the net-shaped member may be made coarser (95% or more in terms of the open area ratio) than in the case where only the net-shaped diffusion electrode is used, so as to further increase the visibility of the luminescent display. Thus, the display tube of the present invention can further increase its working property, can eliminate electrification of the inside surface of the cover plate, and can improve the performance of the diffusion electrode itself.

According to the above embodiment of the present invention, the shield-electrode layers 27 are shown as composed of the electrification-preventing layers 24 and the shield layer 26. However, it is not limited to such an example. Depending on the size and shape of patterns to be displayed, the shield-electrode layers may be formed of the electrification-preventing layers 24 alone, as a matter of course.

The fluorescent display tube according to the present invention has the above-mentioned construction and functions and therefore can obtain various effects as shown below:

(1) The display tube of the present invention has no control electrode between the cathode and anode, which requires severe mounting and dimensional accuracies and reduces visibility of the luminescent display; and has a shield-electrode layer provided on the base plate around and in the vicinity of the segment anodes and a diffusion electrode which requires no severe mounting accuracy and does not reduce visibility of the luminescent display and which is provided on the inside surface of the cover plate or in the vicinity thereof; and therefore is suitable for use with a static driving circuit. As a result, the display tube of the present invention can display patterns far larger in size than the conventional display tube, when used for a digital clock or the like.

(2) The display tube of the present invention can prevent electrification of the portions on and above the base plate in the vicinity of the segment anodes and can intercept the influence of external electric fields on the electric field between the cathode and anode from under the base plate by provision of the shield-electrode layer placed in the vicinity of the segment anodes; and, by the diffusion electrode in the vicinity of the inside surface of the cover plate and the above-mentioned shield-electrode layer, can level the partial unevenness of the electron current between the cathode and anode, which is a defect of a conventional display tube with no control electrode between the cathode and anode, can improve the potential gradient in the vicinity of the cathode thereby to increase the amount of electrons reaching the anode, and can intercept external electric fields. Therefore, it can produce very clear display with no unevenness, defects, non-uniform brightness, etc.

(3) The display tube of the present invention is operated by a static driving circuit and therefore it gives no noise to the near-by external electronic equipment during operation and is not influenced by the near-by external electric fields as mentioned above. Thus, it is advantageously used for the digital display of a digital electronic clock, etc. incorporated in various electronic equipment such as television and radio.

(4) The display tube of the present invention has no control electrode heretofore widely used, which consumes a considerable amount of power and reduces clearness of the display; and has a diffusion electrode positioned at a considerable distance from the cathode, low in power consumption, high in open area ratio in the case of a net-shaped type, and with almost no deterioration of the display clearness. Therefore, it can produce very clear display, and can reduce power consumption when the display clearness is the same as the conventional display tube.

(5) The display tube of the present invention has no control electrode which is disposed between the cathode and anode and requires severe dimensional accuracy, and has a diffusion electrode of the net-shaped type which requires no severe mesh accuracy, mounting and dimensional accuracies. Therefore, it can remarkably improve its working property and productivity and can reduce production cost drastically.

What is claimed is:

1. In a multi-indicia fluorescent display tube for use with a static driving circuit, having a casing formed of a base plate and a cover plate airtightly bonded to each other, said casing containing therein at least a plurality of pattern display sections provided on said base plate in a row for displaying patterns such as characters, figures and symbols and each composed of a plurality of segment anodes each having a fluorescent material layer thereon and a cathode stretched opposite to said pattern display sections, the base plate being insulating to electrically isolate the plurality of segment anodes thereon, the cover plate being light transparent in order to permit viewing of the display, an evacuated environment between the cover plate and the base plate to permit electrons from the cathode to be accelerated toward the segment anodes relatively unimpeded; the improvement which comprises shield electrode layers for at least preventing electrification, provided on the portions of said base plate in the vicinity of said segment anodes, and a diffusion electrode electrically connected to said shield electrode layer for levelling the density of electron current flowing from said cathode to each of said segment anodes during operation by the influence of a positive potential applied thereto with respect to the potential of said cathode, said positive potential maintained between the anode potential and the average of said cathode and anode potentials, said diffusion electrode being provided on the portion of the inside surface of said cover plate opposite to said pattern display sections or in the vicinity of the inside surface of said cover plate.

2. The multi-indicia fluorescent display tube as set forth in claim 1, wherein said diffusion electrode is formed of a net adapted to maintain visibility of the display of said pattern display sections and provided in the vicinity of the inside surface of said cover plate.

3. The multi-indicia fluorescent display tube as set forth in claim 1, wherein said diffusion electrode is formed of at least one of a transparent conductive layer and mesh-shaped printed layer coated on the inside surface of said cover plate.

4. The multi-indicia fluorescent display tube as set forth in claim 1, wherein said shield-electrode layers are composed of electrification-preventing layers provided on an insulating layer coated on said base plate and around and in the vicinity of said segment anodes and substantially flush therewith for preventing electrification, and a shield layer for preventing the influence of external electric fields, said shield layer being provided on said base plate and between said insulating layer and base plate and in the vicinity of the portions corresponding to said segment anodes, elecrification-preventing layers and gaps therebetween.

* * * * *